US005709158A

United States Patent [19]

Wareheim

[11] Patent Number: 5,709,158

[45] Date of Patent: Jan. 20, 1998

[54] SHELF STRUCTURE

[75] Inventor: Robert Oliver Wareheim, St. Charles, Mo.

[73] Assignee: Contico International Company, St. Louis, Mo.

[21] Appl. No.: 480,028

[22] Filed: Jun. 7, 1995

Related U.S. Application Data

[63] Continuation of Ser. No. 221,173, Mar. 31, 1994, abandoned.

[51] Int. Cl.[6] ..... A47B 47/00

[52] U.S. Cl. ..... 108/186; 211/153; 211/188; 108/180

[58] Field of Search ..... 108/144, 180, 108/186, 192, 193, 901; 211/186, 133, 153, 188

[56] References Cited

U.S. PATENT DOCUMENTS

| | | | |
|---|---|---|---|
| D. 304,115 | 10/1989 | Cohn . | |
| D. 312,545 | 12/1990 | Cohn . | |
| D. 341,967 | 12/1993 | Cohn . | |
| 3,757,705 | 9/1973 | Maslow . | |
| 4,103,857 | 8/1978 | Levenhagen | 108/901 X |
| 4,467,612 | 8/1984 | Weasel, Jr. | 108/901 X |
| 4,467,927 | 8/1984 | Nathan | 211/188 X |
| 4,811,670 | 3/1989 | Kolvites et al. . | |
| 4,815,394 | 3/1989 | Ettlinger et al. | 108/901 X |
| 4,843,975 | 7/1989 | Welsch et al. . | |
| 4,964,350 | 10/1990 | Kolvites et al. . | |
| 4,989,519 | 2/1991 | Welsch et al. . | |
| 5,117,762 | 6/1992 | Shuert | 108/51.1 |
| 5,158,187 | 10/1992 | Taub | 211/153 X |

FOREIGN PATENT DOCUMENTS

| | | | |
|---|---|---|---|
| 8606261 | 11/1986 | European Pat. Off. | 211/153 |
| 0 261 681 | 3/1988 | European Pat. Off. | B29C 67/14 |
| 843674 | 8/1960 | United Kingdom | 211/153 |

*Primary Examiner*—Peter M. Cuomo
*Assistant Examiner*—Janet M. Wilkens
*Attorney, Agent, or Firm*—Howell & Haferkamp

[57] ABSTRACT

A plastic molded shelf assembly is comprised of rectangular shelf units. Each shelf unit is comprised of a grid having a beam structure which includes a channel depending from the grid periphery and a longitudinal central channel, the channels having generally U-shaped cross-sections.

26 Claims, 5 Drawing Sheets

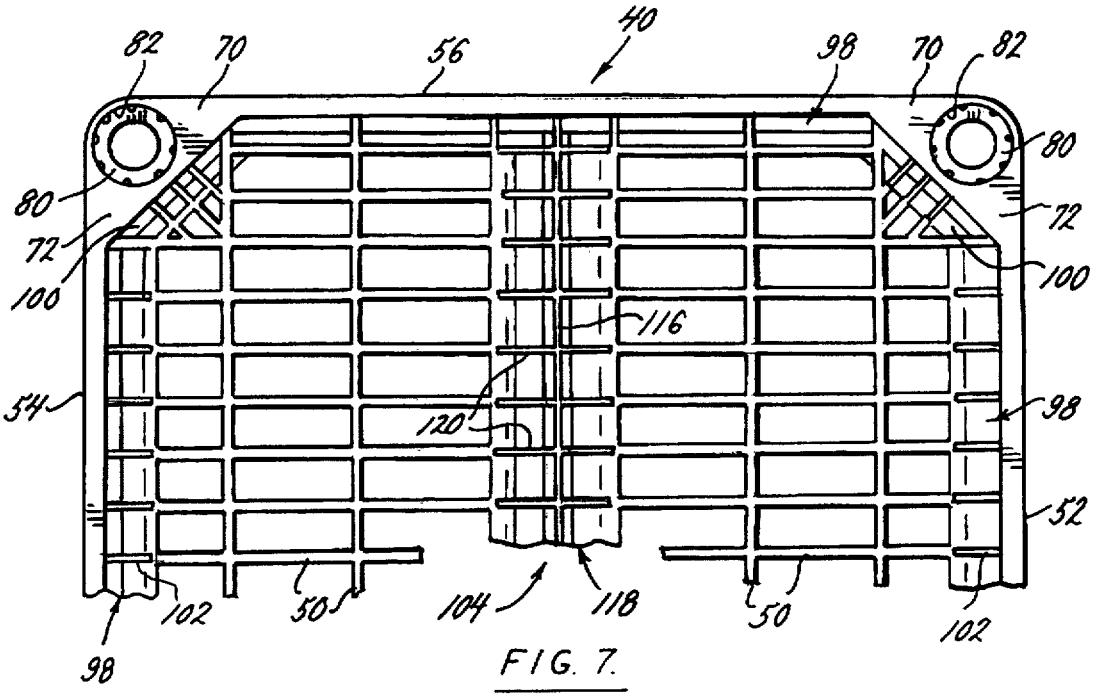
FIG. 7.
FIG. 8.
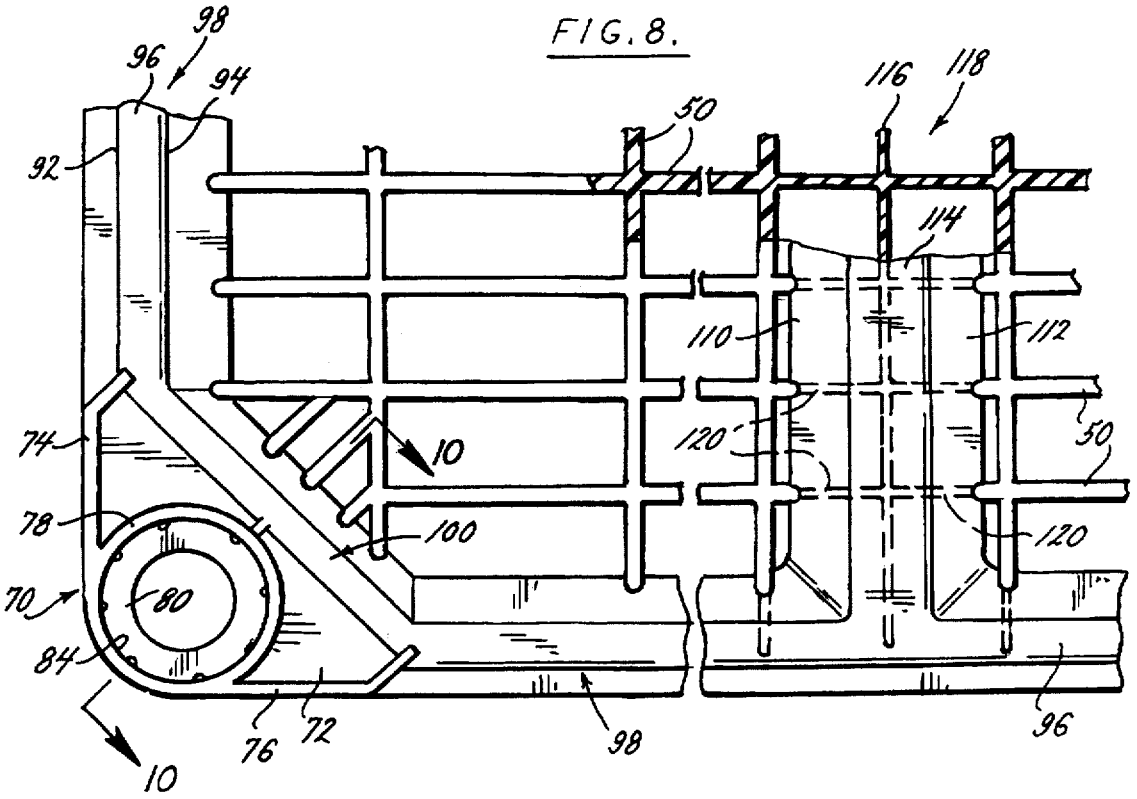

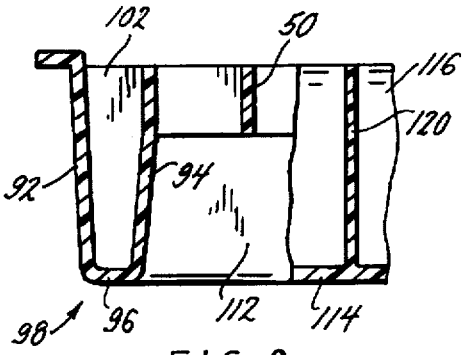
FIG. 9.
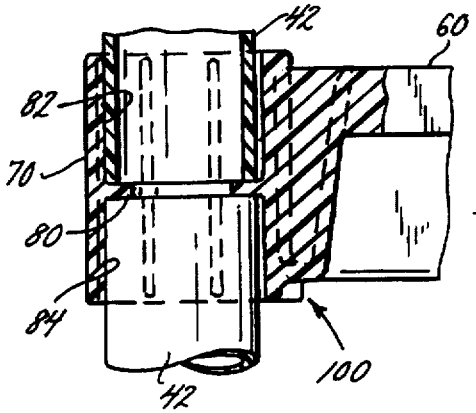
FIG. 10.
FIG. 11.
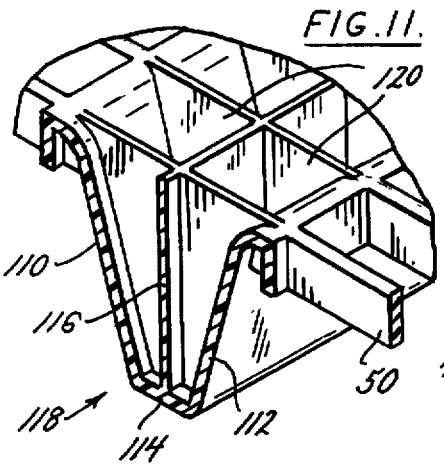
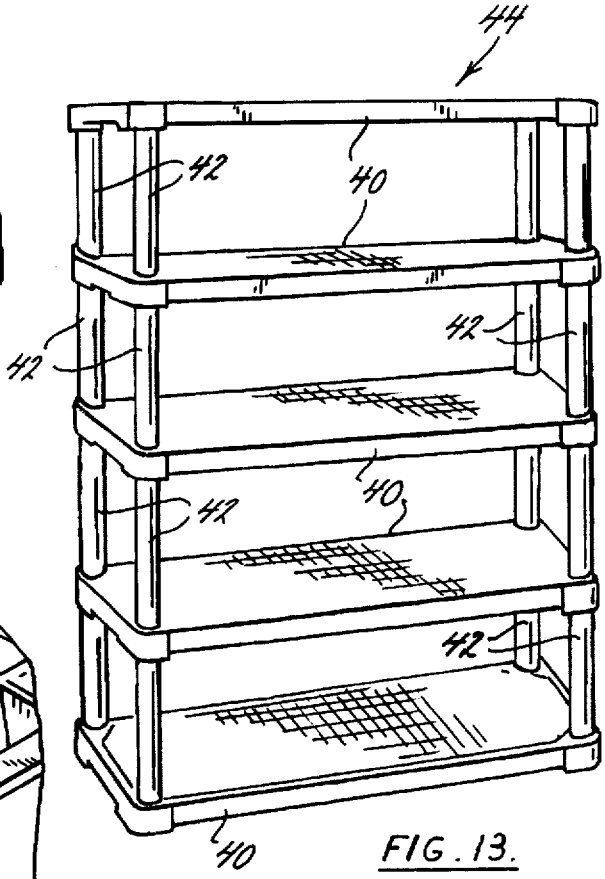
FIG. 13.
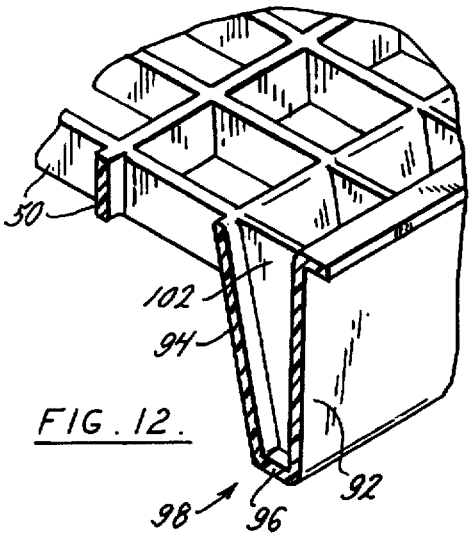
FIG. 12.

SHELF STRUCTURE

This is a continuation of application Ser. No. 08/221,173 filed on Mar. 31, 1994 now abandoned.

BACKGROUND OF THE INVENTION

This invention is directed to the field of utility shelves. The invention is particularly directed to an improved shelf unit having an integral plastic molded, one-piece, construction with an improved structure for increased stiffness and strength.

There are numerous prior art shelf units of the general type to which this invention relates. Typically, these units are relatively low-cost plastic grids separated by poles attached to the corners. The grids have generally planar upper surfaces which form the actual shelf surfaces. When assembled, the shelf units and poles make up shelf assemblies which may be used to store various articles in a neat and orderly fashion.

One such prior art shelf unit 10 is shown in FIGS. 1 and 2 of the drawing. The shelf 10 is comprised of a generally rectangular periphery or outer border 12 and a grid 14 within the periphery. Brackets 16 are integrally molded into the corners and have sockets 18 configured to accept poles (like the poles 42 of FIG. 13) which join multiple units into shelf assemblies (like the assembly 44 of FIG. 13). The prior art shelf unit 10 has structural features to increase the shelf stiffness and strength. Flanges 20 depend from the periphery, and a stiffener rib 22 is centrally located along the length of the grid. In addition, diagonally oriented, vertical braces 24 connect the flanges to the socket brackets, and vertical gussets 26 connect the grid to the flanges, stiffener rib, and braces. Typically, this prior art shelf unit is made of polystyrene which is relatively strong and impact resistant, but is also relatively expensive. Although the unit can be manufactured of less expensive materials, the result is a weaker structure with less impact resistance.

FIGS. 3 and 4 show a second prior art shelf unit. This unit has three longitudinally oriented hollow box beams 30, 32, 34 integrally molded with the grid. Two of these beams 30, 34 are of substantially square cross-section and extend from end to end adjacent the sides of the grid to define the side borders of the periphery. The third beam 32 has a rectangular cross-section and is centrally located in parallel relation to the side beams 30, 34. The resultant structure, with the three parallel box beams, is inherently stiffer and stronger than the first prior art shelf unit thereby permitting the shelf to be molded of less expensive plastic material having weaker mechanical properties. However, there is a significant disadvantage associated with the box beam construction of this prior art unit. The shelf unit requires a relatively complicated mold for molding the unit due to the enclosed hollow box beams. Because of the closed beam structure, inserts must be introduced into the mold from the sides which adds to the cost of the mold and the time for molding each shelf unit which translates into lower productivity and increased cost.

Other prior art shelf structures are illustrated in U.S. Pat. Nos. Des. 304,115 ; Des. 312,545 ; Des. 341,967; 3,757,705; 4,811,670; 4,843,975; 4,964,350 and 4,989,519 as well as European Patent 0 261 681.

The present invention overcomes the disadvantages of the prior art shelves by providing a unique shelf structure which produces a stiff and strong shelf at a reduced cost. Thus, less expensive plastic materials may be substituted for the more expensive materials of the prior art shelf of FIGS. 1 and 2. In addition, the present invention employs a simpler mold thereby reducing the molding time and manufacturing cost as compared to the prior art shelf of FIGS. 3 and 4.

SUMMARY OF THE INVENTION

As with the prior art shelves, the shelf of the present invention has a grid having a generally planar upper shelf surface with brackets having sockets in the corners. However, the present invention has a beam structure which depends from the periphery and center of the grid. The beam structure about the periphery has opposed side walls with a horizontal cross wall connecting the side walls to form a U-shaped channel with an open top in the preferred embodiment. These beams extend substantially the entire length and width of the grid along the sides and ends, respectively. Diagonal portions of the beam bridge the side and end portions adjacent the corner brackets. The beam structure also includes a longitudinally oriented central beam having opposed side walls spaced by a horizontal cross wall and a vertically oriented intermediate wall extending upward from the cross wall, also forming a generally U-shaped channel. These U-shaped beams provide increased strength over the single flange and stiffener rib configuration of the prior art shelf structure of FIGS. 1 and 2 such that less expensive materials may be used to construct the shelf. The configuration also enables the shelf to be readily manufactured with a simple two-piece mold since the shelf does not have any structural members with enclosed hollows or other cavities extending perpendicular to the direction of the mold action. Because no mold inserts are required, the manufacturing time and mold expense are reduced compared to the enclosed box beam construction of the prior art shelf of FIGS. 3 and 4.

Vertical webs are incorporated at intervals between the side walls of the channels to further increase the stiffness and strength of the shelf unit and inhibit buckling. In the preferred embodiment of the present invention, the side walls of the channels diverge to provide draft angles to further improve the "moldability" of the shelf. Thus, the shelf of the present invention solves the problems of the prior art by providing a strong and stiff shelf structure at reduced cost.

BRIEF DESCRIPTION OF THE DRAWINGS

FIG. 7 is a partial top plan view of the shelf of the present invention.

FIG. 8 is a segmented bottom plan view of the shelf.

FIG. 9 is a cross-sectional view of the shelf taken in the plane of line 9—9 of FIG. 6.

FIG. 10 is a cross-sectional view of the shelf taken in the plane of line 10—10 of FIG. 8 showing details of a corner bracket, sockets and poles.

FIG. 11 is an orthographic projection of the E-shaped channel depending from the shelf center.

FIG. 12 is an orthographic projection of the U-shaped channel depending from the shelf periphery.

FIG. 13 is a perspective view of a complete shelving assembly.

DETAILED DESCRIPTION OF THE PREFERRED EMBODIMENT

Figure 1:
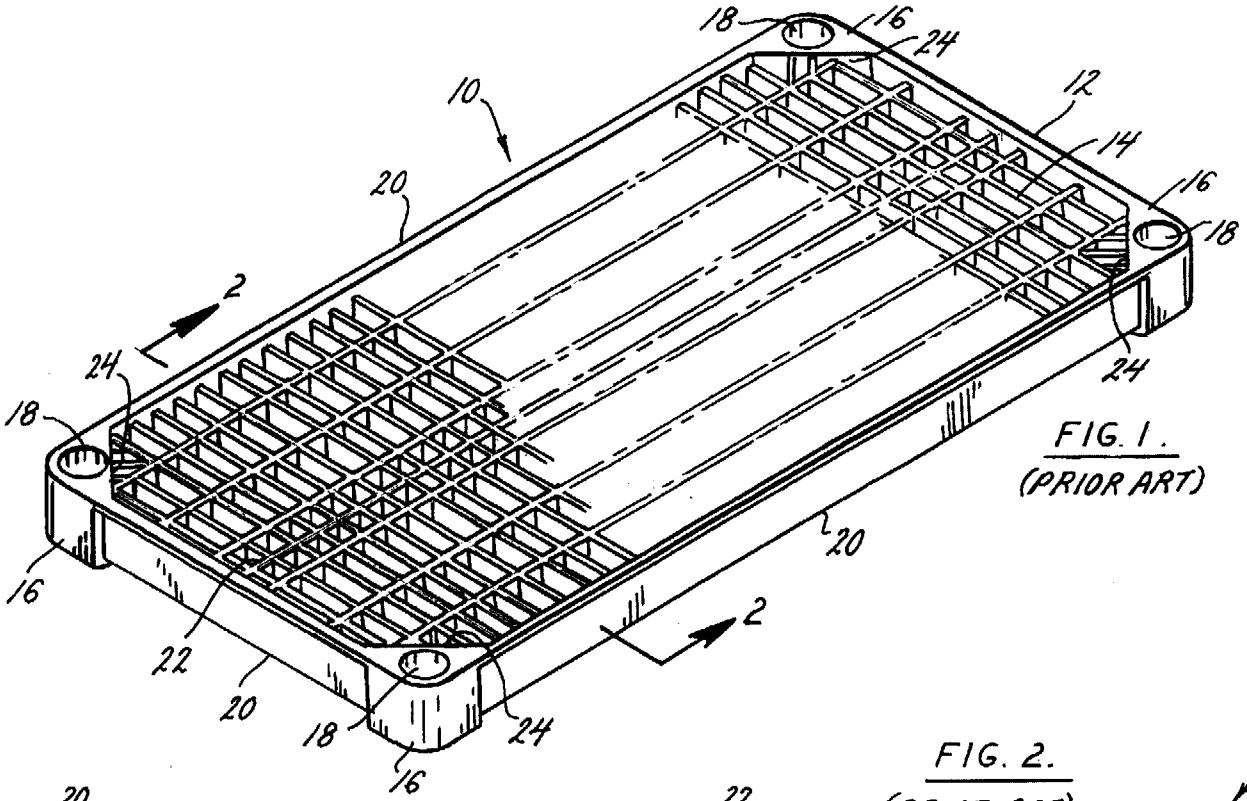
FIG. 1. (PRIOR ART)
FIG. 1 is an orthographic projection of a first prior art shelf unit.
Figure 2:
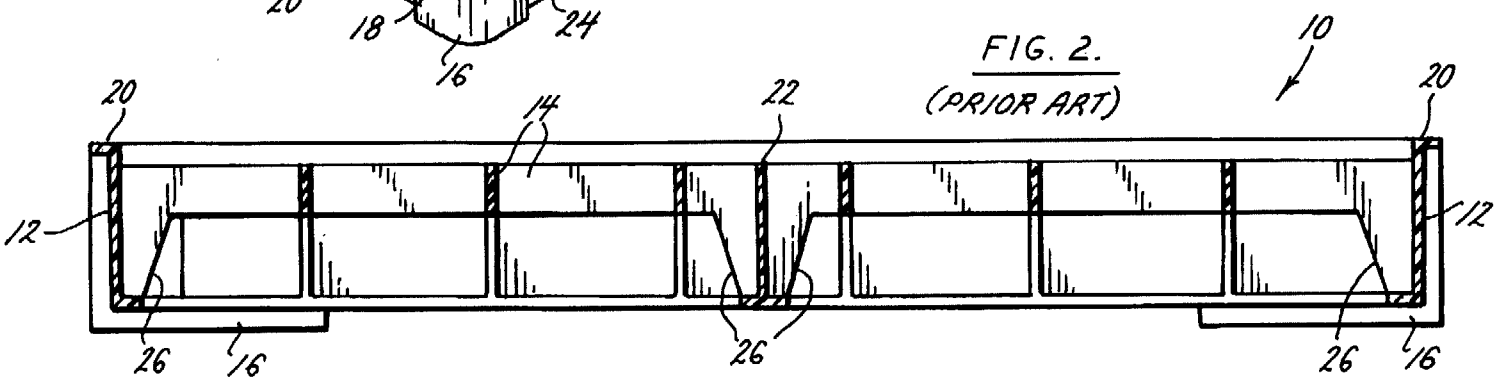
FIG. 2. (PRIOR ART)
FIG. 2 is a cross-sectional view of a first prior art shelf configuration taken in the plane of line 2—2 of FIG. 1.
Figure 3:
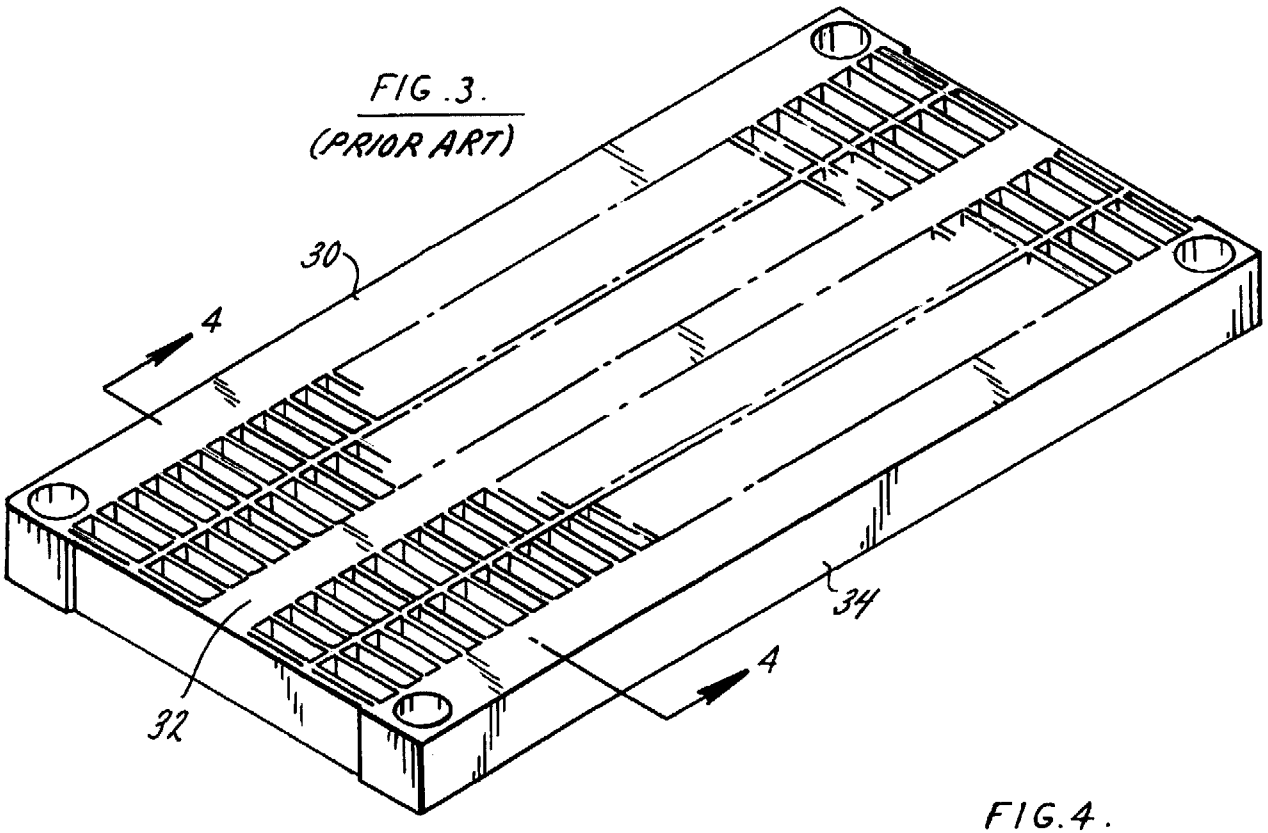
FIG. 3. (PRIOR ART)
FIG. 3 is an orthographic projection of a second prior art shelf unit.
Figure 4:
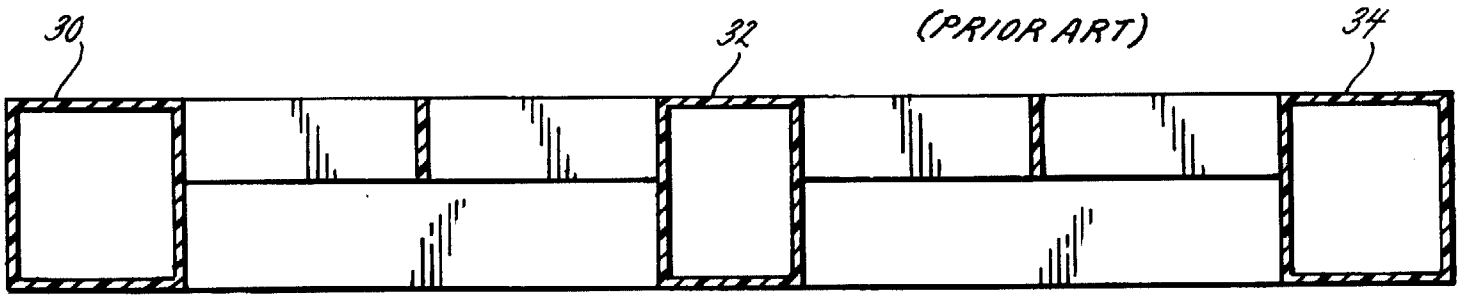
FIG. 4. (PRIOR ART)
FIG. 4 is a cross-sectional view of a second prior art shelf configuration taken in the plane of line 4—4 of FIG. 3.
Figure 5:
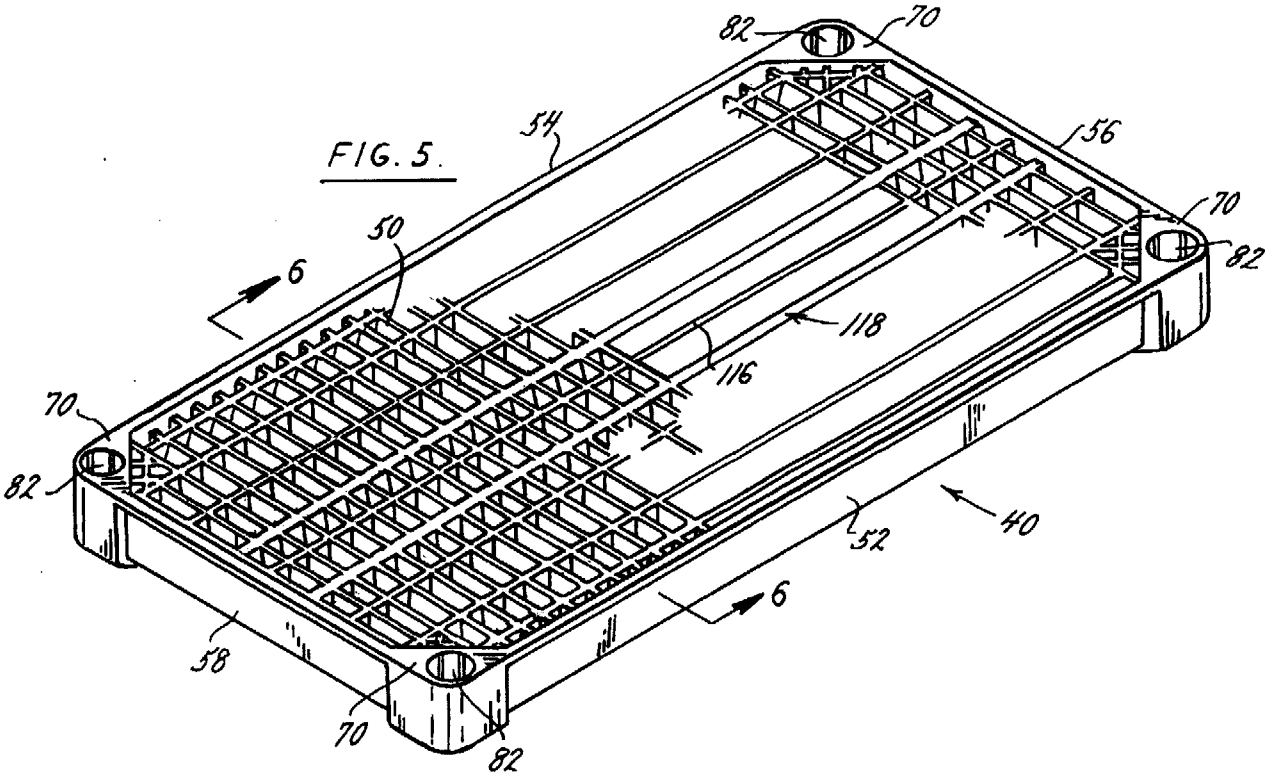
FIG. 5 is an orthographic projection of the shelf of the present invention.
Figure 6:
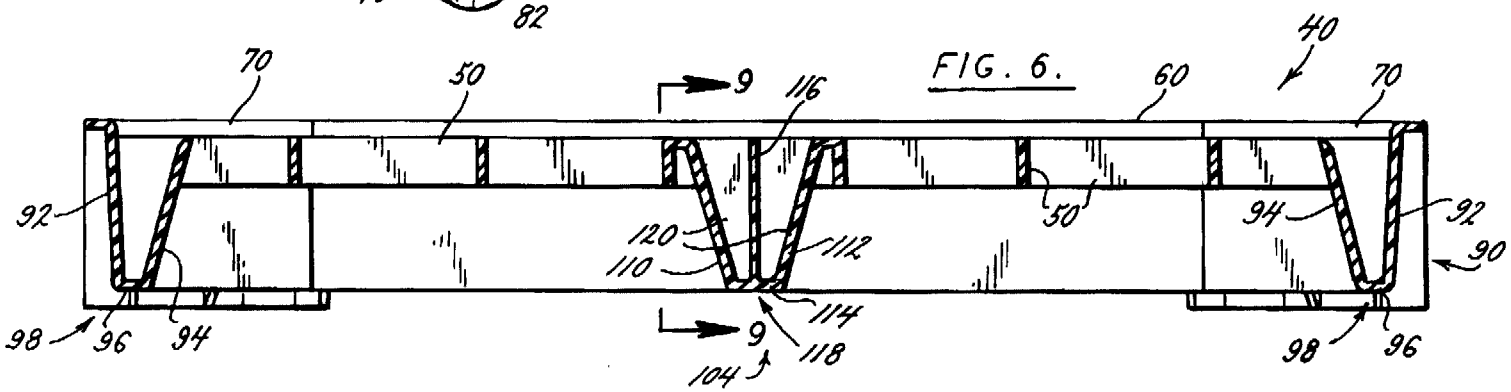
FIG. 6 is a cross-sectional view of the shelf taken in the plane of line 6—6 of FIG. 5.

The shelf unit 40 of the present invention is used in combination with similar shelf units 40 and poles 42 to form a shelving assembly 44 as seen in FIG. 13. As seen in FIGS. 5 through 12, each shelf unit 40 has a rectangular grid 50 extending generally over the interior of the shelf within the peripheral boundary comprised of two longitudinal sides 52, 54 and two lateral ends 56, 58. The grid has a generally planar upper surface 60 which forms at least the majority of the shelf surface upon which articles are stored.

Brackets 70 are integrally molded into the corners of the grid 50. These brackets 70 are comprised of right isosceles triangular plates 72 (FIGS. 8 and 10) which are substantially co-planar with the upper grid surface 60. Flanges 74, 76 depend from the equal length sides of the plate 72 and a vertically-oriented, hollow cylinder 78 depends from the plate 72 adjacent its apex. An annular collar 80 is positioned in the interior of the cylinder 78 approximately halfway between its ends. Thus configured, the portion of the cylinder 78 above the annular collar 80 is an upper pole socket 82 and the portion below the annular collar 80 is a lower pole socket 84.

A beam structure 90 (FIG. 6) depends from the grid about its periphery and longitudinally down its center. The beam structure about the grid periphery is comprised of opposed side walls 92, 94 spaced by a horizontal cross wall 96 connected to the side walls adjacent their bottom edges thereby forming U-shaped channels 98 that open to the top of the shelf. These channels 98 extend between the corner brackets 70 along the sides 52, 54 and ends 56, 58 of the grid. Diagonal U-shaped channels 100 adjacent the corner brackets connect the ends of the side and end channels such that the side and end channels 98 and diagonal channels 100 combine to form a continuous U-shaped channel substantially about the entire periphery of the shelf. Vertically-oriented cross webs 102 extend between the side walls and to the cross wall and are spaced at various distances along the U-shaped channels 98, 100 to inhibit shelf buckling by holding the side walls 92, 94 at a fixed spacing, thus permitting higher shelf loading without failure.

The centrally located portion 104 of the beam structure 90 is comprised of side walls 110, 112 spaced by a cross wall 114 much like the periphery channels 98 to provide a generally U-shaped cross-section open to the top of the shelf. An intermediate wall 116 extends from the cross wall 114 between the side walls 110, 112 to form a channel 118. As with the channels 98, 100, vertical cross webs 120 are spaced along the length of channel 118. The central channel 118 extends essentially the full length of the shelf and intersects at its ends with the end channels 98.

Each of the channels 98, 100, 118 has diverging walls thereby forming a draft angle which facilitates ejection of the shelf from the mold. As seen in the drawings, the channels 98, 100, 118 are substantially greater in depth than the grid 50.

The entire shelf unit 40 is of integral plastic molded, one-piece, construction and may be of polypropylene which is a relatively inexpensive plastic material that provides sufficient strength and impact resistance for the shelf as configured in the present invention. Thus configured, the shelf has inherently increased stiffness and strength such that less expensive materials may be used in its manufacture. Additionally, the configuration allows the shelf unit to be manufactured with a simple two-piece mold without inserts thereby further reducing expense and increasing productivity.

To assemble the shelf units into a shelving assembly, poles are inserted into the upper sockets of one shelf. Then a second shelf is placed upon the poles and the poles are inserted into the lower sockets of the upper shelf. This procedure is repeated until a shelving assembly of the desired height is obtained.

It is to be understood that various overall shelf shapes can be manufactured using the improvements of this invention, and alternate grid structures with various grid sizes and shapes can be employed for aesthetic and functional purposes. Moreover, attachment means other than the sockets can be used to attach the poles to the shelves, and other means for spacing adjacent shelves can be used with the shelves of the present invention.

While the present invention has been described by reference to a specific embodiment, it should be understood that modifications and variations of the invention may be constructed without departing from the scope of the invention defined in the following claims.

What is claimed is:

1. A shelf unit comprising:

a grid of crisscrossing, vertically oriented cross webs defining a generally planar shelf surface, the grid having a periphery;

a plurality of U-shaped channels connected end-to-end and extending completely around the periphery of the grid;

four corner brackets positioned outside the U-shaped channels from the grid, each corner bracket having a cylinder with an interior bore dimensioned for receiving a pole for supporting the shelf unit; and the grid, the plurality of the U-shaped channels and the four corner brackets are all integrally molded as one piece of plastic.

2. The shelf unit of claim 1, wherein:

the grid, the plurality of U-shaped channels and the four corner brackets consist solely of plastic.

3. The shelf unit of claim 1 wherein:

the plurality of U-shaped channels includes a pair of longitudinal channels on opposite sides of the grid, a pair of lateral channels on opposite sides of the grid, and four diagonal channels each positioned adjacent a corner bracket and each connecting a longitudinal channel to a lateral channel.

4. The shelf unit of claim 3, wherein:

a central U-shaped channel extends across the grid between the pair of lateral channels.

5. The shelf unit of claim 4, wherein:

the central U-shaped channel is comprised of opposed side walls spaced by a horizontal cross wall connected to bottom edges of the opposed side walls and an intermediate wall extending from the cross wall between the opposed side walls.

6. The shelf unit of claim 3, wherein:

the plurality of U-shaped channels combine to form a continuous U-shaped channel that surrounds the grid periphery.

7. The shelf unit of claim 3, wherein:

each of the cross webs has opposite top and bottom surfaces and a vertical height between its top and bottom surfaces and each cross web has a constant cross-sectional width between its top and bottom surfaces.

8. The shelf unit of claim 7, wherein:

each U-shaped channel has a vertical height that is larger than the vertical height of the cross webs.

9. The shelf unit of claim 3, wherein:

the cylinder interior bore of each corner bracket has an annular collar herein, and the annular collar has a bottom surface for resting on a pole inserted into the interior bore to support the shelf unit, and the annular collar has a top surface for supporting a pole inserted into the interior bore to support a like shelf unit above the shelf unit.

10. The shelf unit of claim 3, in combination with a plurality of identical shelf units and a plurality of poles, each of the shelf units being spaced from the other shelf units by four of the poles inserted into the cylindrical interior bores of the shelf unit.

11. The shelf unit of claim 1, wherein:

the grid has a top surface and each of the plurality of U-shaped channels has an opening adjacent the top surface of the grid.

12. The shelf unit of claim 11, wherein:

each of the plurality of U-shaped channels is comprised of opposed side walls spaced by a horizontal cross wall connected to bottom edges of the opposed side walls.

13. A shelf unit comprising:

a grid of crisscrossing, vertically oriented cross webs defining a generally planar shelf surface, the grid having a periphery;

a plurality of U-shaped channels extending around the periphery of the grid;

four corner brackets connected to the grid, each corner bracket having a cylinder with an interior bore for receiving a pole for supporting the shelf unit;

the grid, the plurality of U-shaped channels and the four corner brackets being molded integrally of plastic and consisting solely of the plastic; and each of the plurality of U-shaped channels is comprised of a pair of horizontally spaced side walls with opposite top and bottom edges and a horizontal cross wall connected between the bottom edges, the U-shaped channel being open between the side wall top edges.

14. The shelf unit of claim 13, wherein:

each of the cross webs has vertically opposite top and bottom surfaces and a constant cross-sectional width between its top and bottom surfaces.

15. The shelf unit of claim 14, wherein:

the top surfaces of the cross webs extend across the plurality of channels between the side wall top edges of each channel.

16. The shelf unit of claim 14, wherein:

a central U-shaped channel extends across the grid, the central U-shaped channel is comprised of a pair of horizontally spaced side walls with opposite top and bottom edges and a horizontal cross wall connected between the bottom edges, the central U-shaped channel being open between the side wall top edges.

17. The shelf unit of claim 16, wherein:

the top surfaces of the cross webs extend across the central channel between the side wall top edges of the central channel.

18. The shelf unit of claim 16, wherein:

the central channel includes an intermediate wall extending from the cross wall between the pair of horizontally spaced side walls.

19. The shelf unit of claim 14 wherein:

each of the cross webs has a vertical height between its top and bottom surfaces and each U-shaped channel has a vertical height that is larger than the vertical height of the cross webs.

20. The shelf unit of claim 13, wherein:

the plurality of U-shaped channels include a pair of longitudinal channels on opposite sides of the grid, a pair of lateral channels on opposite sides of the grid, and four diagonal channels, each diagonal channel connecting a longitudinal channel to a lateral channel.

21. The shelf unit of claim 20, wherein:

the pair of longitudinal channels, the pair of lateral channels, and the/our diagonal channels are all connected forming a continuous U-shaped channel that completely surrounds the grid.

22. The shelf unit of claim 20, wherein:

the four diagonal channels are positioned on the grid periphery between the grid and the four corner brackets.

23. The shelf unit of claim 13, wherein:

the cylinder interior bore of each corner bracket has an annular collar therein, the annular collar has opposite top and bottom surfaces, the collar top surface supports a pole inserted into the cylinder bore on the top surface and the collar bottom surface supports the shelf unit on a pole inserted into the cylinder bore against the collar bottom surface.

24. The shelf unit of claim 13, wherein:

the shelf unit is one of a plurality of like shelf units and a plurality of poles are inserted into the corner bracket interior bores of the plurality of shelf units connecting the plurality of shelf units to each other in a vertically spaced arrangement.

25. The shelf unit of claim 13, wherein:

the four corner brackets are triangular and are positioned at corners of the shelf unit by the plurality of U-shaped channels.

26. The shelf unit of claim 13, wherein:

the four corner brackets are positioned outside the U-shaped channels from the grid.

* * * * *